US007708374B2

(12) United States Patent
Ha

(10) Patent No.: US 7,708,374 B2
(45) Date of Patent: May 4, 2010

(54) INKJET IMAGE FORMING APPARATUS INCLUDING CAP MEMBER

(75) Inventor: Dong-woo Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 772 days.

(21) Appl. No.: 11/528,388

(22) Filed: Sep. 28, 2006

(65) Prior Publication Data

US 2007/0146413 A1 Jun. 28, 2007

(30) Foreign Application Priority Data

Dec. 23, 2005 (KR) ..... 10-2005-0128706

(51) Int. Cl.
*B41J 2/165* (2006.01)

(52) U.S. Cl. ..... 347/29; 347/30; 347/32; 347/23

(58) Field of Classification Search ..... 347/29, 347/30, 32, 33, 23
See application file for complete search history.

(56) References Cited

U.S. PATENT DOCUMENTS 4,992,805 A 2/1991 Yoshizawa et al.
6,281,912 B1 8/2001 Silverbrook
6,631,973 B1 * 10/2003 Edamura ..... 347/30
6,886,907 B1 5/2005 Okamoto et al.
7,111,921 B2 * 9/2006 Yoshida ..... 347/32
2004/0189740 A1 9/2004 Yoshida
2005/0041059 A1 2/2005 Nakashima et al.

FOREIGN PATENT DOCUMENTS

JP 06-262768 9/1994
JP 11-138831 5/1999
KR 2003-40029 5/2003
WO WO 02/02345 1/2002

OTHER PUBLICATIONS

European search Report dated Oct. 10, 2007 issued in EP 06125037.9.

* cited by examiner

*Primary Examiner*—Shih-Wen Hsieh
(74) *Attorney, Agent, or Firm*—Stanzione & Kim, LLP

(57) ABSTRACT

An inkjet image forming apparatus includes an inkjet head including a nozzle portion having a length in a main scanning direction that is at least equal to a width of a printing medium, a conveying unit to convey the printing medium, a driving motor to drive the conveying unit, and a cap member to cap and uncap the nozzle portion, and the conveying unit and the cap member are driven by the driving motor.

8 Claims, 15 Drawing Sheets

INKJET IMAGE FORMING APPARATUS INCLUDING CAP MEMBER

CROSS-REFERENCE TO RELATED APPLICATIONS

This application claims priority under 35 U.S.C. §119(a) from Korean Patent Application No. 10-2005-0128706, filed on Dec. 23, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to an inkjet image forming apparatus including an inkjet head having a nozzle portion, a length of which in a main scanning direction corresponds to a width of a printing medium, and a cap member to cap the nozzle portion.

2. Description of the Related Art

In general, an inkjet image forming apparatus forms images by ejecting ink from an inkjet head, which reciprocates in a main scanning direction (shuttle type inkjet head), onto a sheet of paper conveyed in a sub-scanning direction. The inkjet head includes a nozzle portion including a plurality of nozzles through which ink is ejected. Ink droplets that are not ejected remain around the nozzle portion. When the nozzle portion is exposed to air when a printing operation is not performed, the ink droplets around the nozzle portion may harden, and impurities, such as fine dust in the air, may attach to the nozzle portion. The hardened ink or impurities may change an ink ejecting direction, thereby degrading printing quality. In addition, since a humidity of the ink in the nozzles evaporates, the nozzles portion may become clogged with ink.

Recently, high speed printing has been performed using an inkjet head (array inkjet head) including a nozzle portion having a length in a main scanning direction corresponding to a width of a sheet of paper. In the inkjet image forming apparatus, the inkjet head is fixed, and sheets of paper are conveyed in a sub-scanning direction. Therefore, a driving unit for the inkjet image forming apparatus has a simple structure, and a printing operation can be performed at a high speed. In the inkjet image forming apparatus, the length of the nozzle portion corresponding to A4 paper is about 210 mm, without considering a printing margin in a width direction of the paper. Since the array inkjet head ejects ink in a fixed position unlike the shuttle type inkjet head reciprocating in the main scanning direction, it is difficult to fix operational problems when some of the nozzles are clogged or when an ejecting direction of the ink is changed due to impurities.

Therefore, when the printing operation is not performed, the nozzle portion should be isolated from the outside (e.g., an environment surrounding the nozzle portion).

SUMMARY OF THE INVENTION

The present general inventive concept provides an inkjet image forming apparatus having a nozzle portion of an array inkjet head that can be capped in order to isolate the nozzle portion from the outside (e.g., an environment surrounding the nozzle portion).

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet image forming apparatus, including an inkjet head including a nozzle portion having a length in a main scanning direction that is at least equal to a width of a printing medium, a conveying unit to convey the printing medium, a driving motor to drive the conveying unit, a cap member to cap the nozzle portion, a cap driving unit to move the cap member to a capping position where the nozzle portion is capped and an uncapping position where the cap member is separated from the nozzle portion when the driving motor rotates in a first direction and in a second direction, and a first clutch to block a driving force of the driving motor to the cap driving unit when the cap member is located at the uncapping position, in which the driving motor moves the cap member to the uncapping position by rotating in the first direction, the conveying unit conveys the paper in the sub-scanning direction to perform a printing operation, and the driving motor moves the cap member to the capping position by rotating in the second direction.

The apparatus may further include a second clutch to block the driving force of the driving motor to the cap driving unit when the cap member is located at the capping position. The first clutch may include a clutch gear connected to the cap driving unit and including gear teeth, the clutch gear including a first idle portion on which the gear teeth are not formed, the first idle portion being formed in a portion of the clutch gear corresponding to the uncapping position, and a first swing gear to connect with the clutch gear when the driving motor rotates in the first direction. The second clutch may include a second swing gear to connect with the clutch gear when the driving gear rotates in the second direction, and a second idle portion formed in a portion of the clutch gear corresponding to the capping position by omitting some of the gear teeth of the clutch gear.

The inkjet image forming apparatus may further include a loading unit in which the printing medium is loaded, a pickup roller to pick up the printing medium from the loading unit, and a pickup motor to drive the pickup roller.

The foregoing and/or other aspects and utilities of the present general inventive concept may also be achieved by providing an inkjet image forming apparatus, including an inkjet head including a nozzle portion having a length in a main scanning direction that is at least equal to a width of a printing medium, a conveying unit to convey the printing medium, a driving motor to drive the conveying unit, a cap member moveable to a capping position where the nozzle portion is capped and to an uncapping position where the cap member is separated from the nozzle portion, a clutch gear connected to the cap member and including gear teeth, the clutch gear including a first idle portion and a second idle portion in portions of the clutch gear corresponding to the capping position and the uncapping position by omitting some of the gear teeth of the clutch gear, and a first swing gear and a second swing gear to connect with the clutch gear when the driving motor rotates in a first direction and a second direction, respectively, in which the conveying unit and the cap member are driven simultaneously by the driving motor.

The foregoing and/or other aspects and utilities of the present general inventive concept may also be achieved by providing an image forming apparatus, including a print head unit including a nozzle unit having a plurality of nozzles to eject ink to form an image on a printing medium, a conveying unit to convey the printing medium along a conveying path to the print head unit, a capping unit comprising a capping member to separate the nozzle unit from an environment surrounding the nozzle unit, the capping unit being movable between a capping position at which the nozzle unit is capped by the cap member and an uncapping position at which the nozzle unit is uncapped, a driving unit to generate a driving force to drive the conveying unit to convey the print medium along the conveying path to the print head unit, and to drive the capping unit to move to the capping position and the uncapping position, and a clutch unit to prevent the driving force from driving the capping unit when the capping unit is at the uncapping position.

The clutch unit may prevent the driving force from driving the capping unit when the capping unit is at the capping position. The clutch unit may include a first clutch part to prevent the driving force from driving the capping unit when the capping unit is in the uncapping position, and a second clutch part to prevent the driving force from driving the capping unit when the capping unit is in the capping position. The image forming apparatus may further include a detection unit to detect a position of the capping unit.

The driving unit may include a driving motor to generate the driving force, the driving motor being rotatable in a first direction to drive the conveying unit to convey the print medium along the conveying path to the print head unit and to drive the capping unit to move to the uncapping position, and a second direction to drive the capping unit to move to the capping position. The clutch unit may include a clutch gear to rotate the capping unit to move the capping unit to the capping position and the uncapping position, the conveying unit may include a roller to convey the printing medium and a conveying gear to rotate the roller, and the driving unit may include a pulley to transmit the driving force generated by the driving motor to the clutch gear and the conveying gear. The clutch unit may further include a first clutch part to prevent the driving force from driving the capping unit when the capping unit is in the uncapping position, the first clutch part comprising a first idle portion corresponding to the uncapping position and a first swing gear to communicate with the clutch gear, and a second clutch part to prevent the driving force from driving the capping unit when the capping unit is in the capping position, the second clutch part comprising a second idle portion corresponding to the capping position and a second swing gear to communicate with the clutch gear.

The foregoing and/or other aspects and utilities of the present general inventive concept may also be achieved by providing a method of separating a nozzle unit of a print head unit from an environment surrounding the nozzle unit, the method including conveying a printing medium along a conveying path to the print head unit by rotating a driving unit in a first direction to form an image on the printing medium, preventing the driving unit rotating in the first direction from driving a movement of a capping unit using a clutch unit when the capping unit is at an uncapping position spaced apart from the nozzle unit, moving the capping unit towards the nozzle by rotating the driving unit in a second direction to cap the nozzle unit, and preventing the driving unit rotating in the second direction from driving a movement of the capping unit using the clutch unit when the capping unit is at a capping position at which the nozzle unit is capped by the capping unit.

The method may further include uncapping the nozzle unit and moving the nozzle unit to the uncapping position by rotating the driving unit in the first direction, and preventing the driving unit rotating in the first direction from driving a movement of the capping unit using the clutch unit when the capping unit is at the uncapping position.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
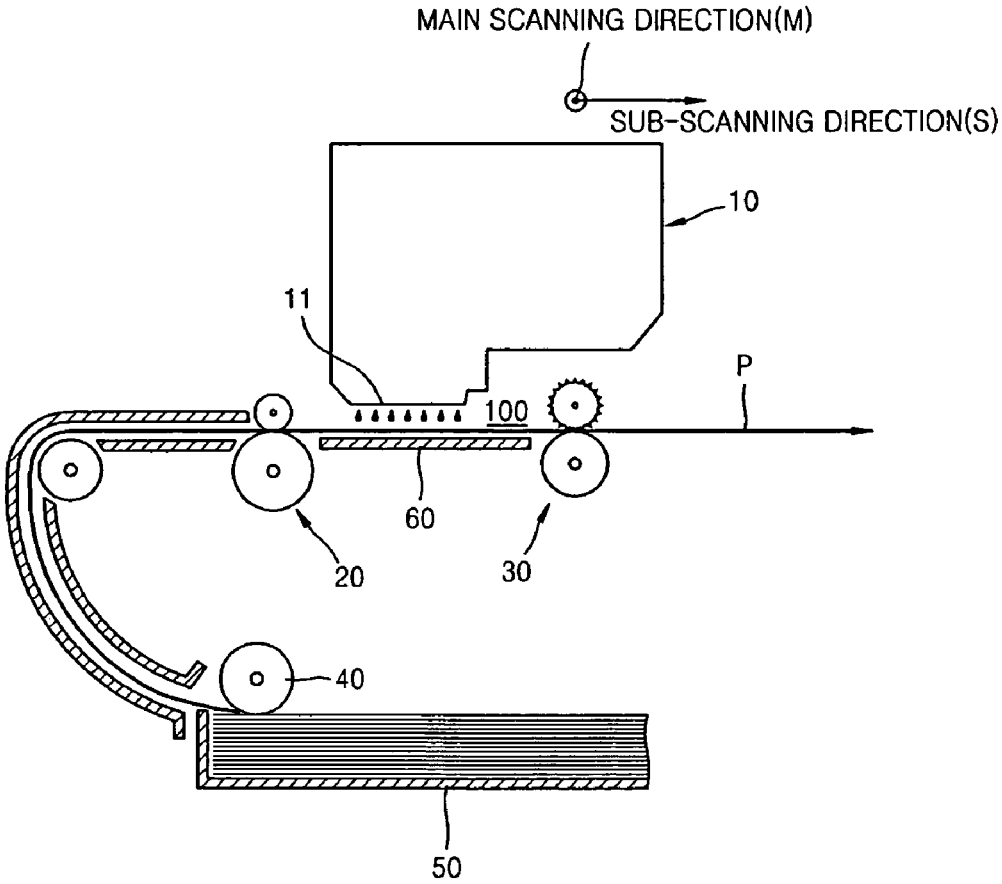
FIG. 1 is a block diagram illustrating an inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an inkjet image forming apparatus according to an embodiment of the present general inventive concept. Referring to FIG. 1, a printing medium, such as a sheet of paper (P), picked from a paper cassette (loading unit) 50 by a pickup roller 40 is conveyed in a sub-scanning direction (S) by a feed roller 20. An inkjet head 10 is installed above the paper (P). The inkjet head 10 ejects ink onto the paper P at a fixed position to print an image on the paper P. A discharge roller 30 is installed in an outlet portion of the inkjet head 10 to discharge the paper P on which the image is printed.

Figure 2:
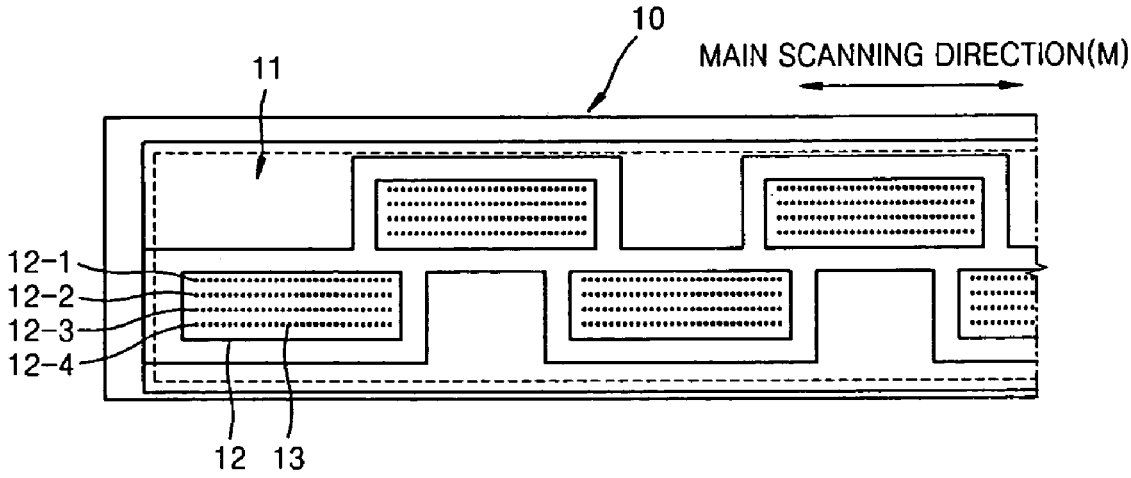
FIG. 2 is a view illustrating a nozzle portion of the inkjet image forming apparatus of FIG. 1 according to an embodiment of the present general inventive concept.

The inkjet head 10 is an array inkjet head. In addition, a length of a nozzle portion 11 in a main scanning direction (M) is at least equal to a width of the paper P. FIG. 2 illustrates an example of the nozzle portion 11. Referring to FIG. 2, the nozzle portion 11 includes a plurality of nozzle plates 12 arranged in zigzag in the main scanning direction M. Each of the nozzle plates 12 includes a plurality of nozzles 13 to eject ink. The nozzle plate 12 may include a plurality of nozzle rows 12-1, 12-2, 12-3, and 12-4. In addition, the nozzle rows 12-1, 12-2, 12-3, and 12-4 may eject ink of the same color or may eject ink of different colors (for example, cyan, magenta, yellow, and black). FIG. 2 illustrates an example of the nozzle portion 11; however, the present general inventive concept is not limited thereto. The inkjet head 10 may include a chamber (not illustrated) having a discharge unit (for example, a piezoelectric device or a heater) connected to the nozzle to provide a driving force to discharge ink, and a flowing path to supply ink to the chamber. The chamber, the discharge unit, and the flowing path (not illustrated) are well known to those who skilled in the art, and thus, detailed descriptions are omitted.

A platen 60 faces the nozzle portion 11 and supports a rear surface of the paper P, thereby forming a paper conveying path 100. The platen 60 is positioned so that the nozzle portion 11 of the inkjet head 10 is kept at a predetermined distance, for example, about 0.5 mm to about 2 mm, from the paper P.

If the nozzle portion 11 is exposed to air when a printing operation is not performed, ink droplets around the nozzle portion 11 may harden, and impurities (such as fine dust in the air) can attach to the nozzle portion 11. The hardened ink or the impurities may change an ink ejecting direction of the nozzles 13, and may degrade the printing quality. In addition, since a humidity of the ink in the nozzles 13 evaporates continuously, a viscosity of the ink in the nozzles 13 increases. Further, the ink in the nozzles 13 may be hardened. Thus, the nozzle portion 11 may be clogged by the ink of high viscosity or the hardened ink. Since the inkjet head 10 prints the image at a fixed position, if some of the nozzles 13 are clogged with ink, a white line appears in the printed image at a portion corresponding to the nozzle that is clogged.

The nozzle portion 11 should maintain an optimal condition to perform the printing operation in order to obtain high printing quality. To do this, maintenance operations, such as a preliminary spitting process, a wiping process, and a capping operation, can be performed. If the printing operation is not performed for a predetermined period of time, or if there are nozzles 13 that are not used for a predetermined period of time during the printing operation, the ink in the nozzles 13 and around the nozzles 13 is dried and a viscosity of the ink increases, and thus, a defective ejecting operation may occur. The preliminary spitting is an operation of spitting ink a few times in a predetermined time period in order to remove the ink having the increased viscosity. In the wiping process, a surface of the nozzle portion 11 is wiped in order to remove the hardened ink and impurities around the nozzles 13. The capping process is performed in order to separate the nozzle portion 11 from the outer air (e.g., an environment surrounding the nozzle portion 11) and to prevent the nozzles 13 from drying by capping the nozzle portion 11 when the printing operation is not performed for a predetermined period of time.

Figure 3:
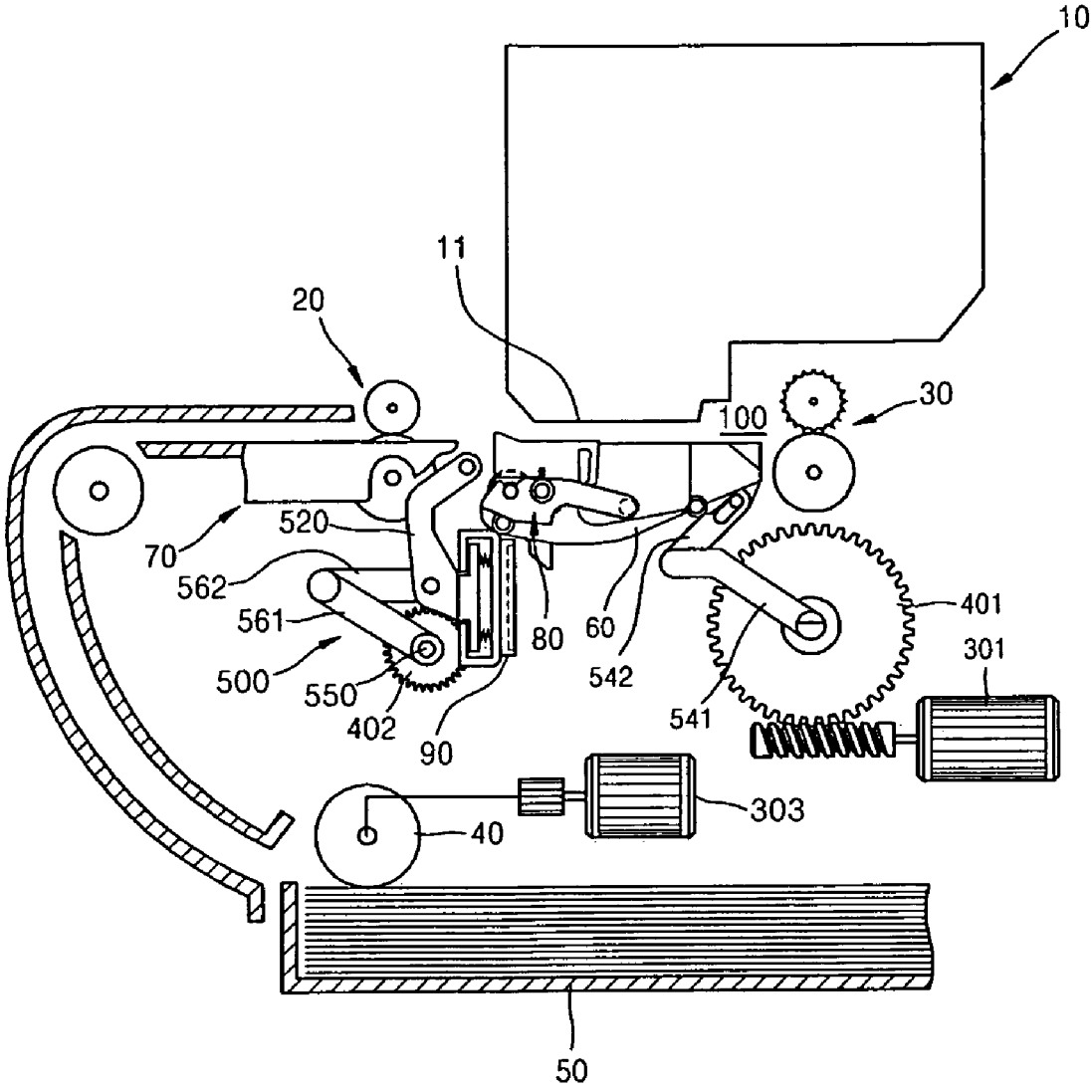
FIG. 3 is a side view illustrating the inkjet image forming apparatus of FIG. 1.

To maintain the nozzle portion 11 in a suitable condition to perform the printing operation, the inkjet image forming apparatus according to the present embodiment includes a cap member 90 to cap the nozzle portion 11 to isolate the nozzle portion 11 from the outer air (e.g., the environment surrounding the nozzle portion 11), and a wiping unit 80 to clean the nozzle portion 11, as illustrated in FIG. 3. In the image forming apparatus according to the present embodiment, the platen 60 can move between a printing position (refer to FIG. 3) along the paper conveying path 100 and a maintenance position (refer to FIG. 10) where the platen 60 moves away from a lower portion of the nozzle portion 11 so that the cap member 90 can access the nozzle portion 11. A conveying unit including the feed roller 20 and the discharge roller 30 to convey the paper P does not move. The wiping unit 80 is installed on the platen 60 to be moved with the platen 60 while cleaning the nozzle portion 11.

Figure 4:
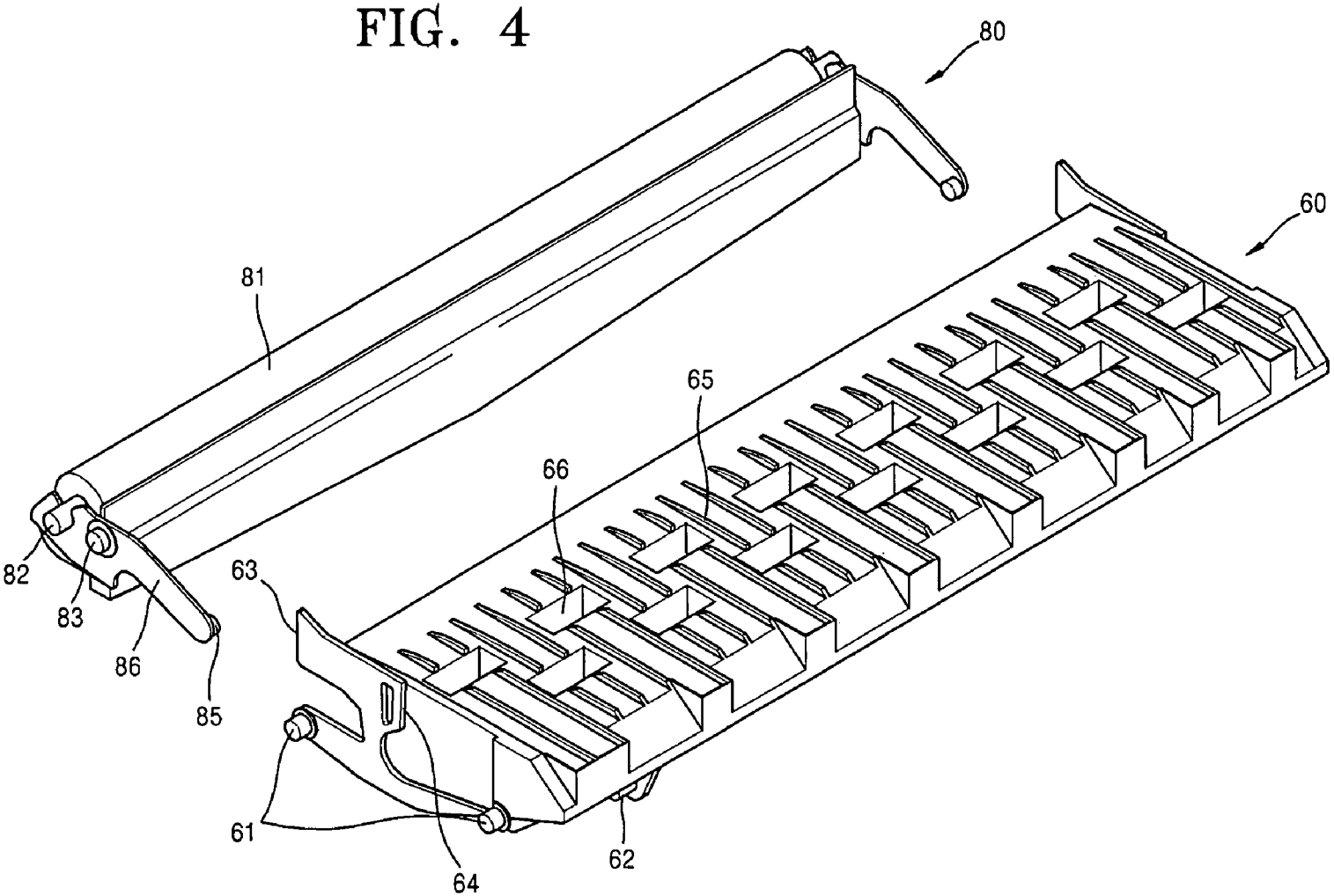
FIG. 4 is an exploded perspective view illustrating a platen and a wiping unit of the inkjet image forming apparatus of FIG. 1 according to an embodiment of the present general inventive concept.

Referring to FIG. 4, the platen 60 includes a plurality of ribs 65 supporting the rear surface of the paper P. In addition, the platen 60 includes a plurality of receiving portions 66 corresponding to the plurality of nozzle plates 12 illustrated in FIG. 2 in order to receive the preliminarily spitted ink. The platen 60 includes a coupling portion 64 on a side portion thereof. The wiping unit 80 includes a supporting member 86 and a wiper 81. The wiper 81 of the present embodiment is a roller that rotates while contacting the nozzle portion 11. An axis 82 of the wiper 81 is coupled to the supporting member 86. The supporting member 86 includes a first protrusion 83 that is inserted into a wiping trace 150 (see FIGS. 5 and 6) that will be described later together with the axis 82 of the wiper 81, and a second protrusion 85 coupled to the coupling portion 64. A front edge portion 63 of the platen 60 pushes the axis 82 of the wiper 81 when the platen 60 moves to the printing position from the maintenance position. The coupling portion 64 pulls the wiping unit 80 when the platen 60 moves to the maintenance position from the printing position.

Figure 5:
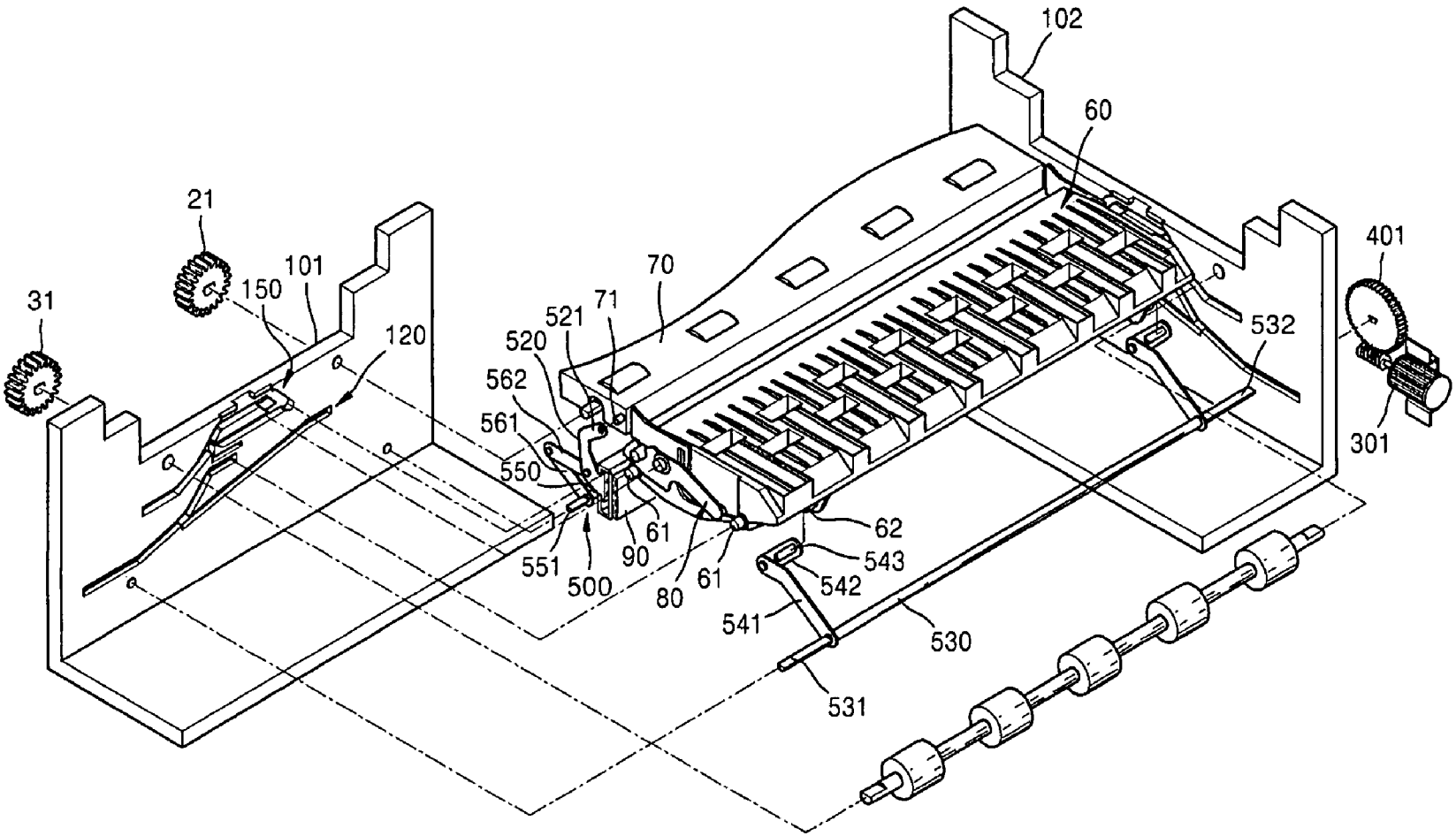
FIG. 5 is an exploded perspective view illustrating the inkjet image forming apparatus of FIG. 1.

Referring to FIG. 5, the platen 60 is coupled to side walls 101 and 102. The side walls 101 and 102 respectively include guide slots 120 illustrated in FIGS. 5 and 6. Protrusions 61 are formed on both sides of the platen 60. The protrusions 61 are inserted into the guide slots 120. The platen 60 moves to the printing position or the maintenance position along the guide slots 120. Each of the guide slots 120 includes parallel sections 121 that are parallel to the paper conveying path 100, and slant sections 122 that are inclined. A connection arm 542 includes an elongated slot 543. The slot 543 is inserted into a guide pole 62 formed on the platen 60. A shaft 530 is rotatably supported by the side walls 101 and 102. D-cut portions 531 and 532 are formed on both ends of the shaft 530. A pair of connection arms 541 are coupled to the D-cut portions 531 and 532 of the shaft 530, and are respectively connected to the pair of connection arms 542 to be rotated. A gear 401 is coupled to the D-cut portion 532. A maintenance motor 301 rotates the gear 401 to move the platen 60 to the printing position or to the maintenance position.

Figure 6:
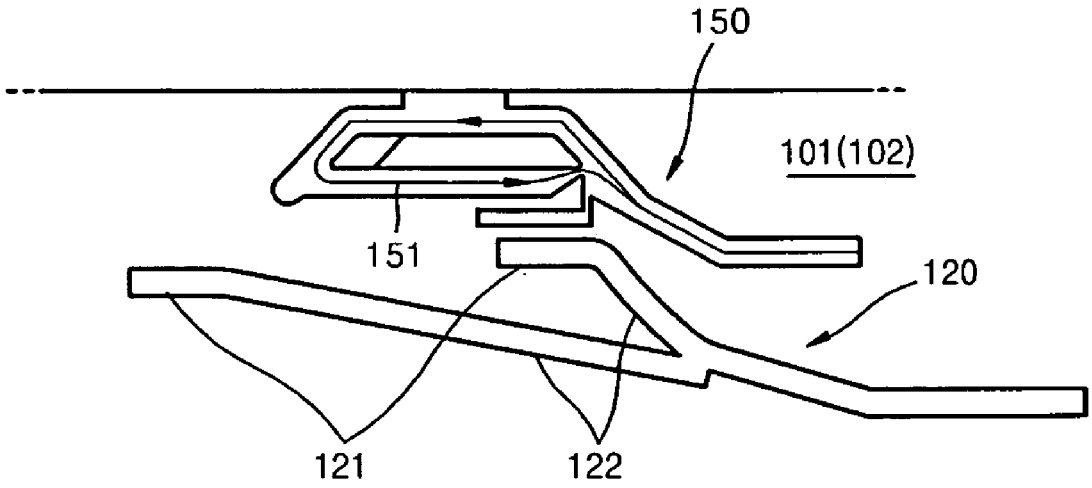
FIG. 6 is a detailed view illustrating a guide slot and a wiping trace of the image forming apparatus illustrated in FIG. 5 according to an embodiment of the present general inventive concept.

Referring to FIGS. 5 and 6, the wiping trace 150 is formed on the side walls 101 and 102. The axis 82 and the first protrusion 83 of the wiping unit 80 are inserted into the wiping trace 150. When the platen 60 moves from the printing position to the maintenance position and from the maintenance position to the printing position, the axis 82 and the first protrusion 83 are guided by the wiping trace 150 in an arrow direction 151, as illustrated in FIG. 6. Therefore, the wiping unit 80 wipes the nozzle portion 11 when the platen 60 moves from the maintenance position to the printing position.

FIGS. 3 and 5 illustrate a cap driving unit 500 to move the cap member 90 to a capping position and an uncapping position. The cap driving unit 500 includes a cap arm 520, a shaft 550, and connection arms 561 and 562. An end 521 of the cap arm 520 is coupled to a rotary shaft 71 formed on a guide member 70. The cap member 90 is installed on the other end of the cap arm 520, opposite to the end 521 coupled to the rotary shaft 71. The shaft 550 is rotatably supported by the side walls 101 and 102. D-cut portions 551 are disposed on both ends of the shaft 530 (one D-cut portion 551 is illustrated in FIG. 5). The pair of connection arms 561 (one connection arm 561 of the pair is illustrated in FIG. 5) is coupled to the D-cut portion 551 of the shaft 550, and is rotatably connected to the pair of connection arms 562 (one connection arm 562 of the pair is illustrated in FIG. 5). The pair of connection arms 562 are rotatably connected to the pair of cap arms 520 (one cap arm 520 of the pair is illustrated in FIG. 5).

According to the image forming apparatus of the present embodiment, the cap member 90 is moved to the capping and uncapping positions using a driving motor 302 (refer to FIG. 7) driving the conveying unit. In this case, the pickup roller 40 picking a sheet of paper P from the paper cassette 50 can be driven by a driving force generated by a pickup motor 303 illustrated in FIG. 3. Otherwise, the pickup roller 40 can be driven by the driving motor 302. In this case, a clutch unit (not illustrated) may be used to selectively transmit the driving force of the driving motor 302 to the pickup roller 40. A detailed description of the clutch unit is omitted since it is well known in the art.

Figure 7:
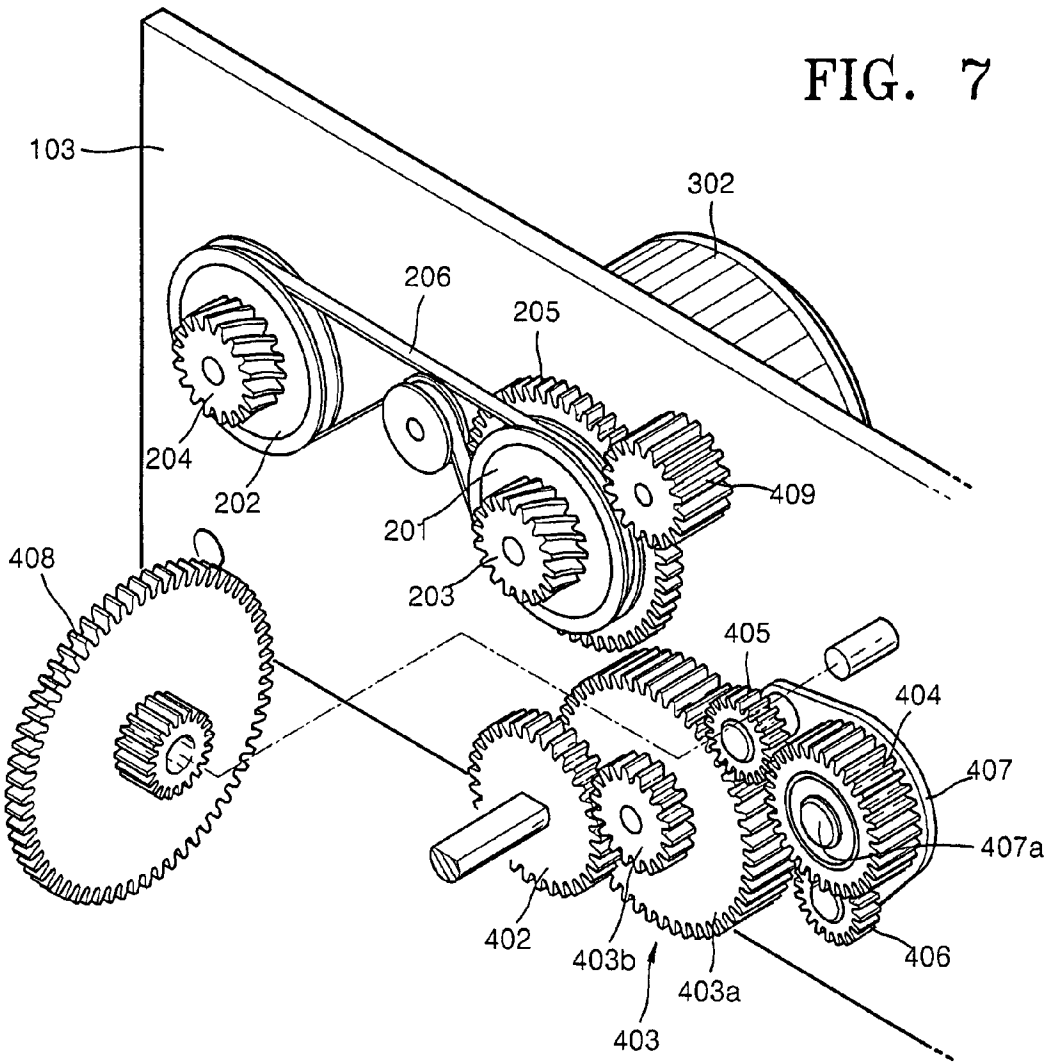
FIG. 7 is an exploded perspective view illustrating a structure to drive a cap member and a conveying unit using a driving motor in the image forming apparatus of FIG. 1 according to an embodiment of the present general inventive concept.

FIG. 7 illustrates a driving bracket 103. The driving bracket 103 is coupled to the side wall 101. A first pulley 201 and a second pulley 202 are coupled to the driving bracket 103. The first pulley 201 is rotated by the driving motor 302. The first and second pulleys 201 and 202 are connected to each other through a belt 206. In addition, the first and second pulleys 201 and 202 include gear portions 203 and 204, respectively. The gear portions 203 and 204 are connected to a conveying gear 21 (refer to FIG. 5) that is coupled to the feed roller 20 and to a discharge gear 31 (refer to FIG. 5) that is coupled to the discharge roller 30, respectively.

The cap driving unit 500 is connected to the driving motor 302 through a gear portion 205 of the first pulley 201. When the image is printed onto the paper P, the cap member 90 should be located at the uncapping position. When the paper P is not picked from the paper cassette 50 by the pickup motor 303, the paper P is not conveyed even if the driving motor 302 rotates in a first direction, that is, a direction to convey the paper P in the sub-scanning direction S by the feed roller 20 and the discharge roller 30. Therefore, before driving the pickup motor 303, the driving motor 302 can be rotated in the first direction to move the cap member 90 to the uncapping position. When the cap member 90 is located at the uncapping position, the driving motor 302 rotates in the first direction to perform the printing operation. The image forming apparatus of the present embodiment includes a first clutch (see FIGS. 8A and 8B) so that the driving force of the driving motor 302 is not transmitted to the cap driving unit 500 even when the driving motor 302 rotates in the first direction when the cap member 90 is located at the uncapping position.

When the driving motor 302 rotates in a second direction, that is, the opposite direction to the first direction, the paper P is not conveyed. Therefore, the cap member 90 can be moved to the capping position by rotating the driving motor 302 in the second direction. When the cap member 90 reaches the capping position, the driving motor 302 stops operating. A detecting unit (not illustrated) to detect the position of the cap member 90 may be included in order to determine when the driving motor 302 stops operating. However, the image forming apparatus of the present embodiment can include a second clutch (see FIGS. 8A and 8B) so that the driving force from the driving motor 302 is not transmitted to the cap driving unit 500 when the driving motor 302 rotates in the second direction when the cap member 90 is located at the capping position. According to the above structure, the detecting unit to detect the position of the cap member 90 is not necessary.

Referring to FIG. 7, a clutch gear 403 includes a first gear portion 403*a* and a second gear portion 403*b*. The first gear portion 403*a* is connected to a cap gear 402 that is coupled to the d-cut portion 551 of the shaft 550. A first swing gear 405 and a second swing gear 406 are coupled to a swing arm 407, and are engaged with a gear 404 that is located on a swing shaft 407*a* of the swing arm 407. The gear 404 is connected to the gear portion 203 of the first pulley 201 via gears 408 and 409.

Figure 8A:
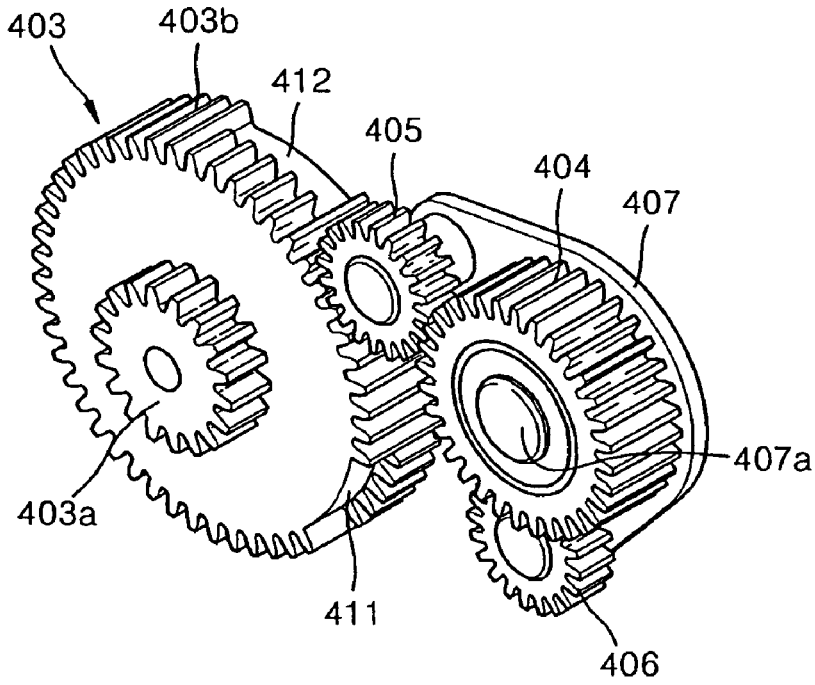
FIG. 8A is a perspective view illustrating an example of a first clutch and a second clutch according to an embodiment of the present general inventive concept.
Figure 8B:
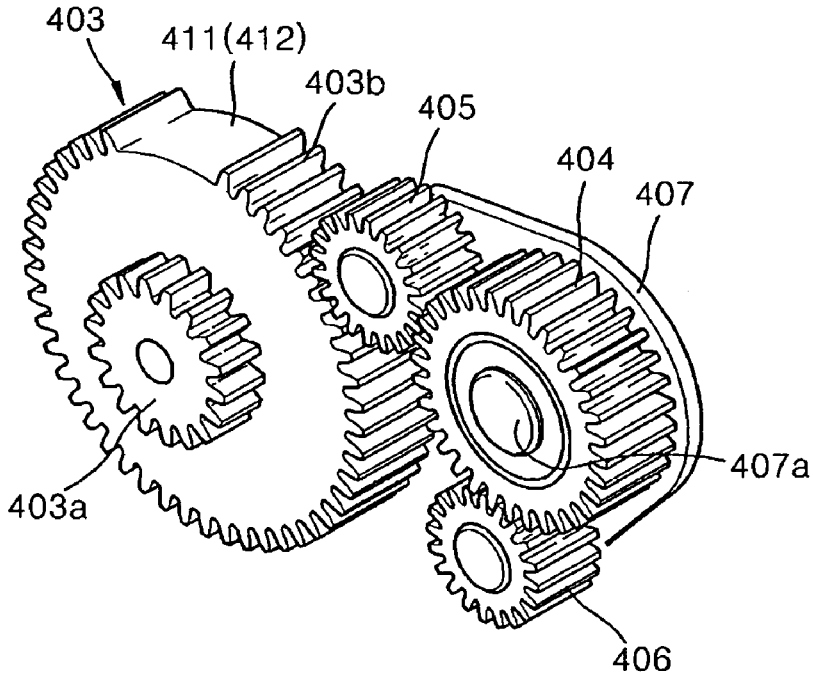
FIG. 8B is a perspective view illustrating another example of the first clutch and the second clutch according to an embodiment of the present general inventive concept.

Referring to FIG. 8A, the second gear portion 403*b* of the clutch gear 403 includes a first idle portion 411 and a second idle portion 412, having no teeth. The first and second idle portions 411 and 412 correspond to the uncapping position and the capping position, respectively. In addition, the first and second idle portions 411 and 412 correspond to the first swing gear 405 and 406, respectively. The first and second idle portions 411 and 412 are staggered in an axial direction of the clutch gear 403, and the first and second swing gears 405 and 406 are also staggered in the axial direction of the clutch gear 403. In addition, as illustrated in FIG. 8B, the first and second idle portions 411 and 412 can be formed at the same portion of the clutch gear 403. In this case, the clutch gear 403 may be larger than the clutch gear 403 of FIG. 8A.

The first swing gear 405 and the first idle portion 411 perform as the first clutch that blocks the driving force of the driving motor 302 transmitting to the cap driving unit 500, when the cap member 90 is located at the uncapping position. In addition, the second swing gear 406 and the second idle portion 412 perform as the second clutch such that the driving force of the driving motor 302 is not transmitted to the cap driving unit 500, when the cap member 90 is located at the capping position.

Figure 9A:
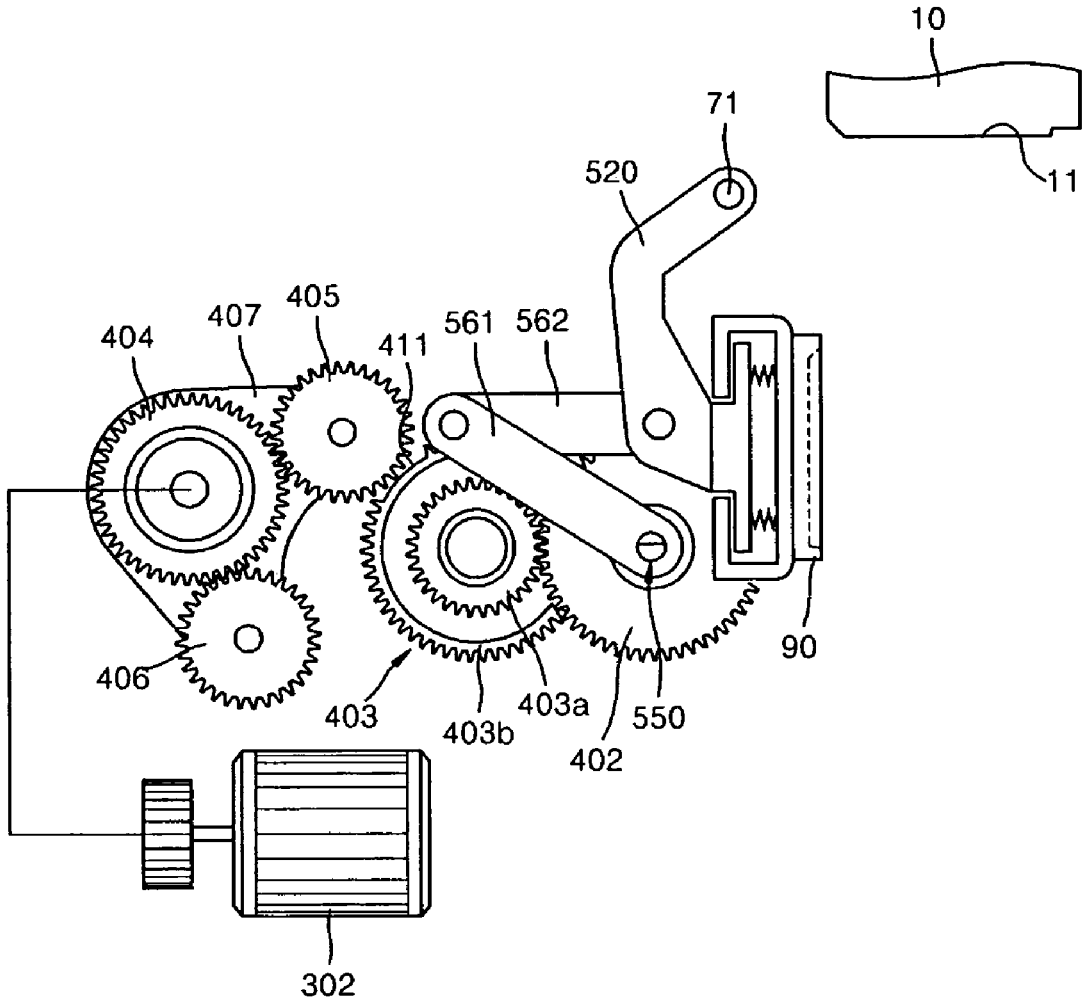
FIGS. 9A through 9F are views illustrating processes of moving a cap member to an uncapping position and a capping position according to an embodiment of the present general inventive concept.

Maintenance operations will be described using the above structure. Referring to FIG. 3, the platen 60 is located at the printing position and supports the rear surface of the paper P. The protrusion 61 of the platen 60 is supported by the parallel section 121 of the guide slot 120 (see FIG. 6). Therefore, even if the position accuracy of the platen 60 at the printing position is low, a distance between the nozzle portion 11 and the upper surface of the paper P can be maintained accurately as long as the protrusion 61 is supported by the parallel section 121. The wiping unit 80 and the cap member 90 are disposed under the platen 60. The wiping unit 80 is separated from the nozzle portion 11. As illustrated in FIGS. 3 and 9A, the cap member 90 is located at the uncapping position.

When the pickup motor 303 (see FIG. 1) rotates, the paper P is picked from the paper cassette and is conveyed to the feed roller 20. When the paper P reaches the feed roller 20, the pickup motor 303 stops operating. When the driving motor 302 rotates in the first direction, the conveying roller (feed roller) 20 conveys the paper P in the sub-scanning direction S. Referring to FIG. 9A, since the first swing gear 405 is located at the first idle portion 411, the clutch gear 403 is not rotated even if the driving motor 302 rotates in the first direction. The driving force of the driving motor 302 is not transmitted to the cap driving unit 500. Therefore, the cap member 90 does not move. The nozzle portion 11 spits the ink onto the paper P to print the image. The discharge roller 30 discharges the printed paper P.

Figure 10:
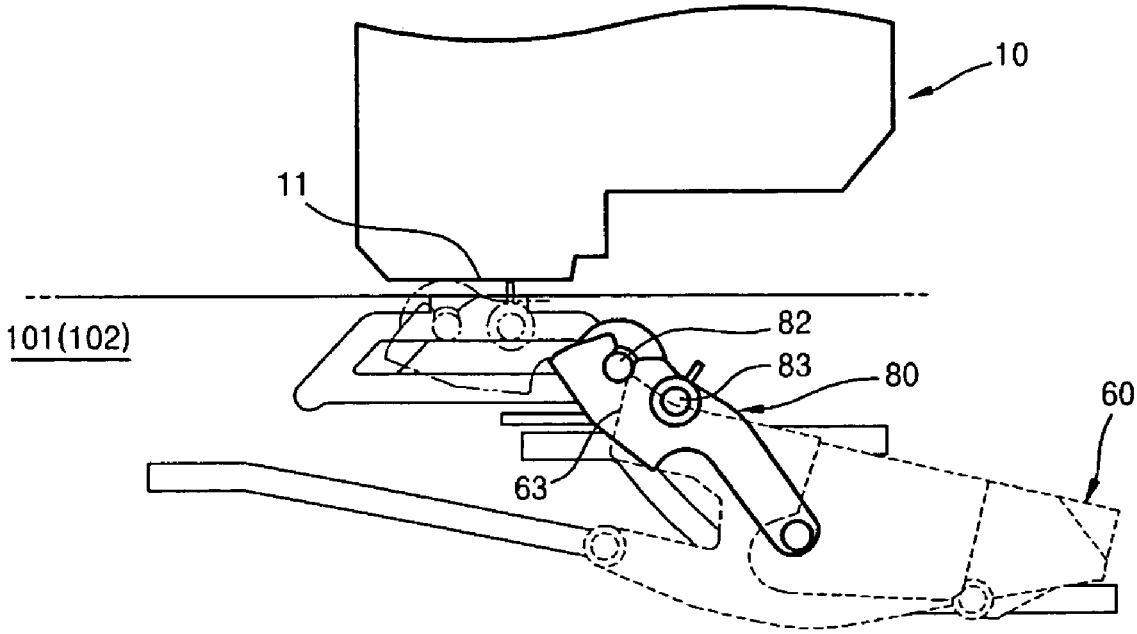
FIG. 10 is a view illustrating the wiping unit and the platen of FIG. 4 in a maintenance position.

When the printing operation is completed, the platen 60 is moved to the maintenance position and the nozzle portion 11 is capped. When the maintenance motor 301 rotates the gear 401, the shaft 530 and the connection arms 541 and 542 connected to the shaft 530 are rotated. The slot 543 of the connection arm 542 pulls the guide pole 62. The protrusion 61 of the platen 60 is guided by the slant section 122 after escaping from the parallel section 121. The platen 60 is guided to the maintenance position, as illustrated in FIG. 10. In addition, the wiping unit 80 moves together with the platen 60. The wiping unit 80 does not contact the nozzle portion 11 as the platen 60 moves to the maintenance position.

Figure 9B:
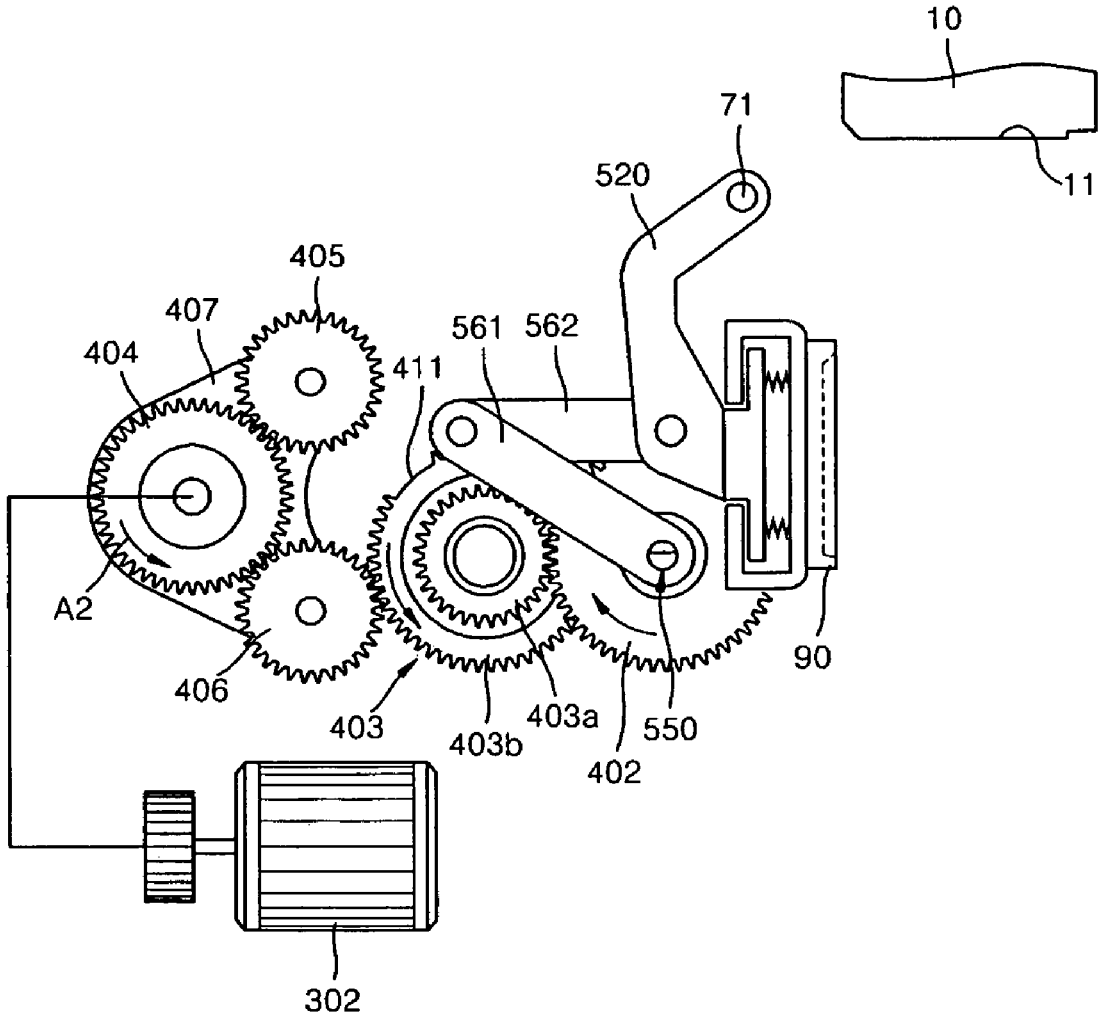

In order to cap the nozzle portion 11, the driving motor 302 is driven. At this time, the paper P is not picked from the paper cassette 50, and thus, the paper P is not conveyed even when the driving motor 302 is rotated in the first or second direction. When the driving motor 302 rotates in the second direction, the gear 404 rotates in a direction denoted as A2 in FIG. 9B. The swing arm 407 swings in the A2 direction, and thus, the second swing gear 406 is engaged with the second gear portion 403*b* of the clutch gear 403. Accordingly, the driving force of the driving motor 302 is transmitted to the cap driving unit 500. The connection arms 561 and 562 push the cap arm 520.

Figure 9C:
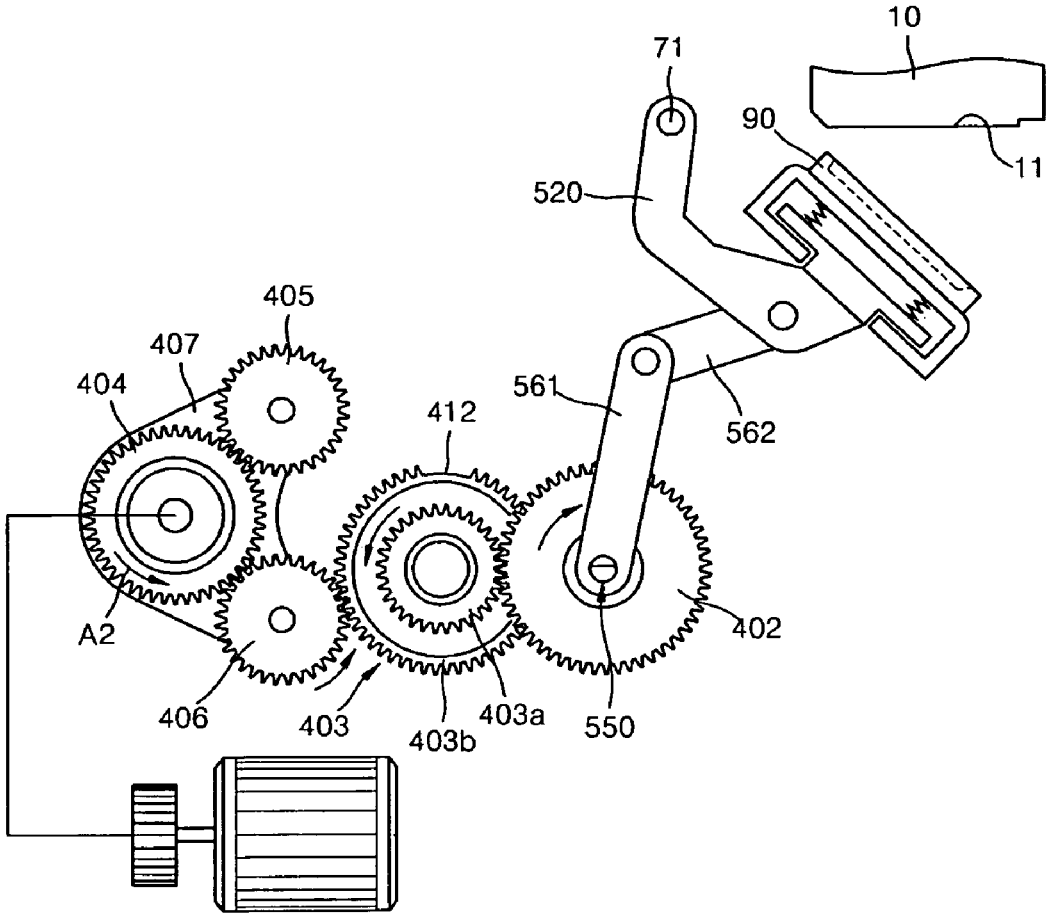
Figure 9D:
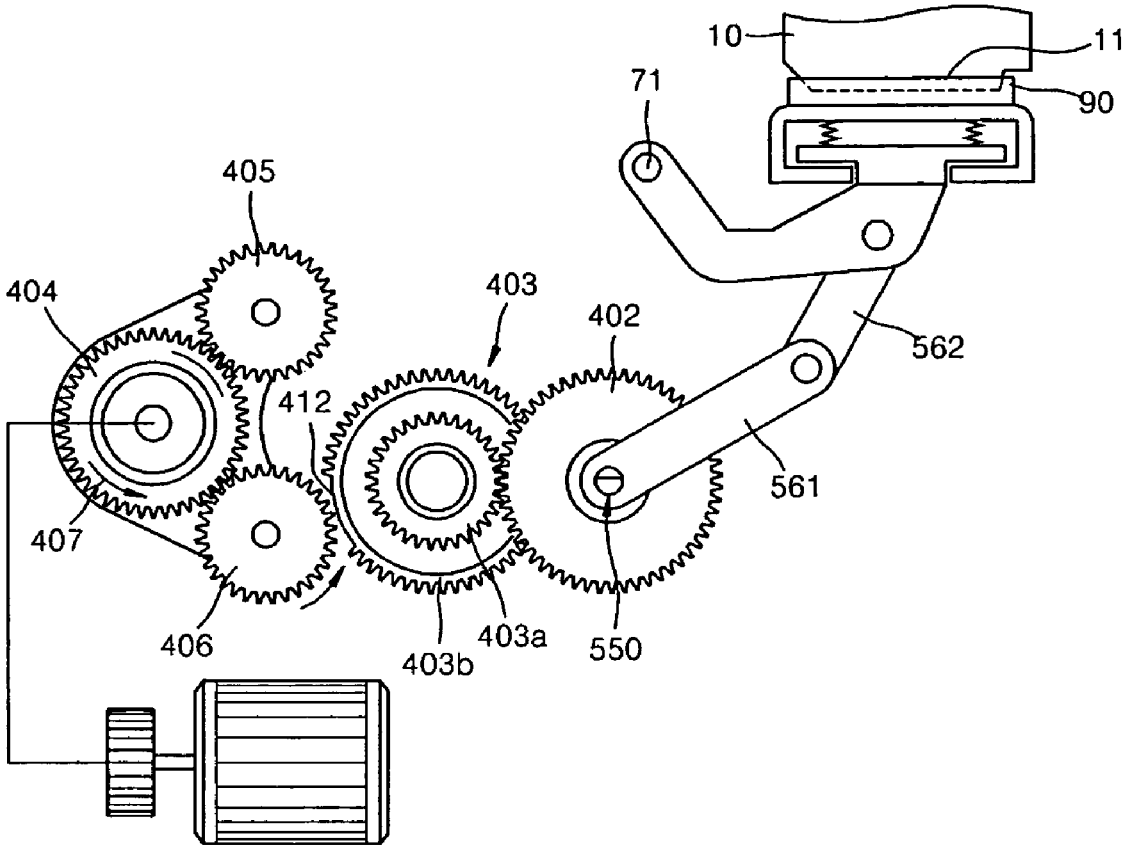

Referring to FIG. 9C, the cap arm 520 rotates about the rotary shaft 71, and the cap member 90 approaches the nozzle portion 11. Referring to FIG. 9D, when the cap member 90 reaches the capping position, the second swing gear 406 is located at the second idle portion 412 of the clutch gear 403. The driving force of the driving motor 302 in not transmitted to the cap driving unit 500. Therefore, even though the driving motor 302 rotates in the second direction, the cap member 90 does not move. When the printing operation is not performed for a time longer than a predetermined period time, the cap member 90 covers the nozzle portion 11 to prevent the nozzles 13 from drying.

When a printing command is input again, the nozzle portion 11 is uncapped and the platen 60 is moved to the printing position before driving the pickup motor 303. To perform the uncapping operation, the driving motor 302 rotates in the first direction. Since the paper P is not picked yet from the paper cassette 50, the paper P is not conveyed when the driving motor 302 rotates in the first direction for performing the uncapping operation.

Figure 9E:
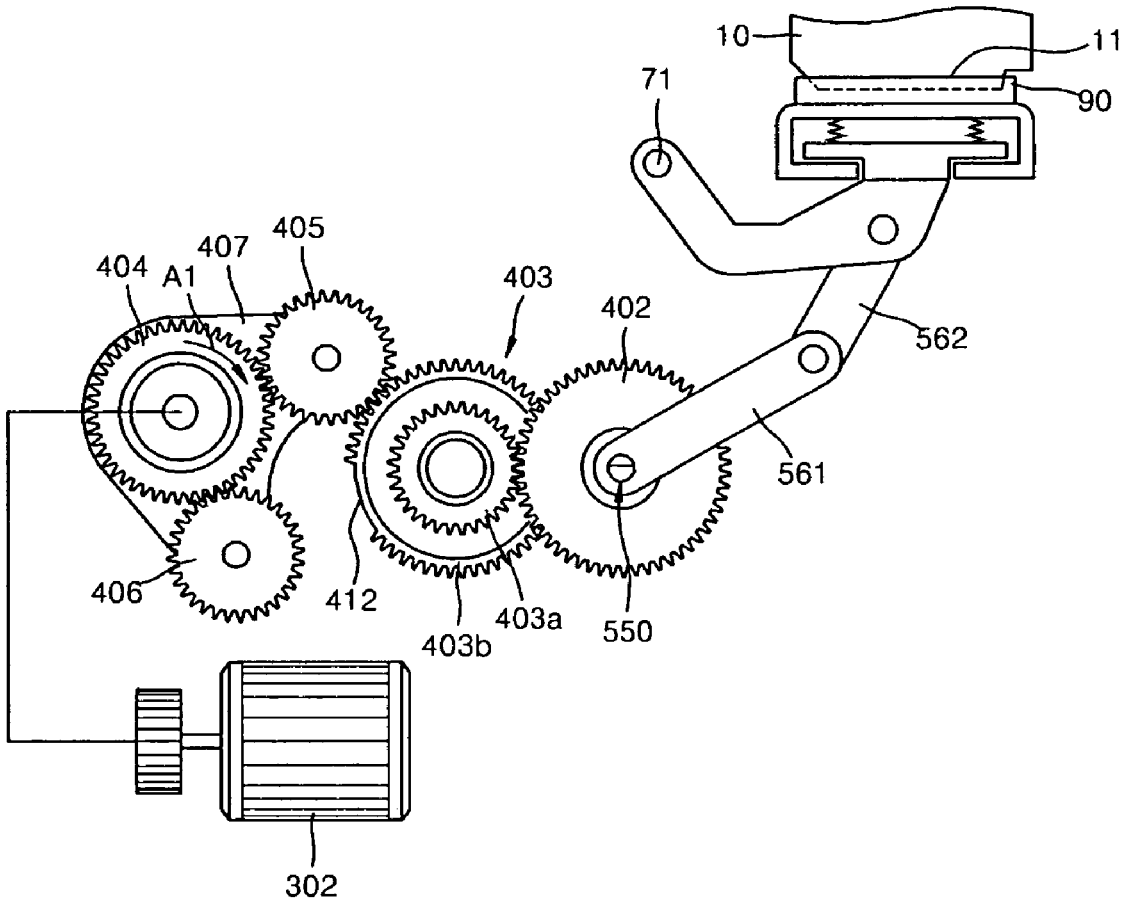

Referring to FIG. 9E, when the driving motor 302 rotates in the first direction, the gear 404 rotates in a direction A1. Then, the swing arm 407 swings in the direction A1, and thus, the second swing gear 406 is separated from the second gear portion 403*b* of the clutch gear 403, and the first swing gear 405 is engaged with the second gear portion 403*b* of the clutch gear 403. The connection arms 561 and 562 pull the cap arm 520.

Figure 9F:
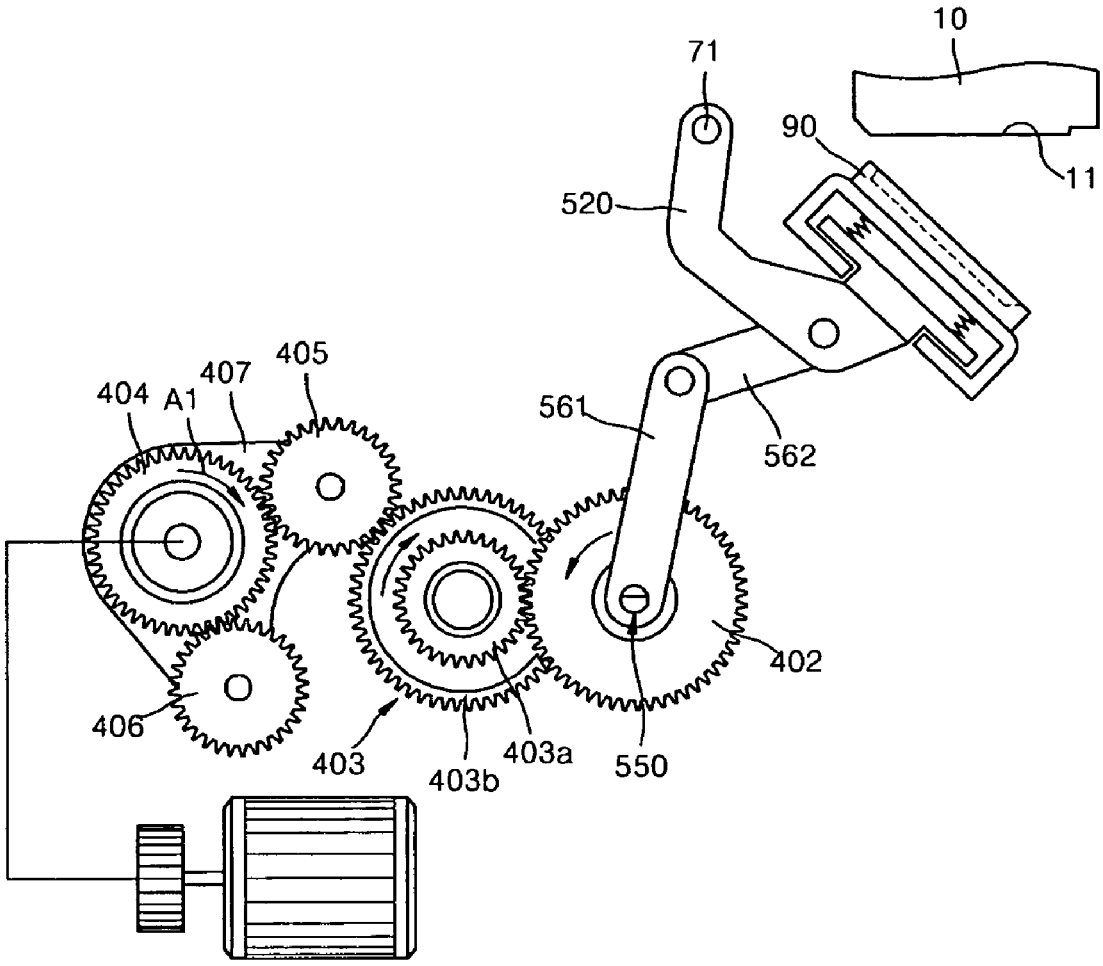

Referring to FIG. 9F, the cap arm 520 rotates about the rotary shaft 71, and the cap member 90 is separated from the nozzle portion 11. Referring to FIG. 9A, when the cap member 90 reaches the uncapping position, the first swing gear 405 is located at the first idle portion 411 of the clutch gear 403. Therefore, when the driving motor 302 rotates, the cap member 90 does not move.

Next, when the maintenance 301 rotates the gear 401, the platen 60 is moved to the printing position. As illustrated by a dashed dot line in FIG. 10, the wiping unit 80 contacts the nozzle portion 11 and removes impurities from the nozzle portion 11. In addition, the platen 60 reaches the printing position. The printing operation is performed in this state.

According to the inkjet image forming apparatus according to embodiments of the present general inventive concept, a cap member is moved to capping and uncapping positions using a driving motor that drives a conveying unit, and thus, a nozzle portion can be capped using a simple structure and at low costs.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus, comprising:

an inkjet head including a nozzle portion having a length in a main scanning direction that is at least equal to a width of a printing medium;

a conveying unit to convey the printing medium;

a cap member to cap the nozzle portion;

a cap driving unit to move the cap member to a capping position where the nozzle portion is capped and an uncapping position where the cap member is separated from the nozzle portion when the driving motor rotates in a second direction and in a first direction, respectively;

a driving motor connected to the cap driving unit and the conveying unit, wherein the driving motor drives the cap driving unit to move the cap member to the uncapping position and the conveying unit to convey the paper in the sub-scanning direction to perform a printing operation by rotating the first direction, and the driving motor drives the cap driving unit to move the cap member to the capping position by rotating in the second direction; and a first clutch to block a driving force of the driving motor in the first direction to the cap driving unit when the cap member is located at the uncapping position such that the cap member is maintained in the uncapping position while the conveying unit conveys the printing medium.

2. The apparatus of claim 1, further comprising:

a second clutch to block the driving force of the driving motor to the cap driving unit when the cap member is located at the capping position.

3. The apparatus of claim 2, wherein the first clutch comprises:

a clutch gear connected to the cap driving unit and including gear teeth, the clutch gear including a first idle portion on which the gear teeth are not formed, the first idle portion being formed in a portion of the clutch gear corresponding to the uncapping position; and a first swing gear to connect with the clutch gear when the driving motor rotates in the first direction.

4. The apparatus of claim 3, wherein the second clutch comprises:

a second swing gear to connect with the clutch gear when the driving gear rotates in the second direction; and a second idle portion formed in a portion of the clutch gear corresponding to the capping position by omitting some of the gear teeth of the clutch gear.

5. The apparatus of claim 1, further comprising:

a loading unit in which the printing medium is loaded;

a pickup roller to pick up the printing medium from the loading unit; and a pickup motor to drive the pickup roller.

6. An inkjet image forming apparatus, comprising:

an inkjet head including a nozzle portion having a length in a main scanning direction that is at least equal to a width of a printing medium;

a conveying unit to convey the printing medium;

a driving motor to drive the conveying unit;

a cap member moveable to a capping position where the nozzle portion is capped and to an uncapping position where the cap member is separated from the nozzle portion;

a clutch gear connected to the cap member and including gear teeth, the clutch gear including a first idle portion and a second idle portion in portions of the clutch gear corresponding to the capping position and the uncapping position by omitting some of the gear teeth of the clutch gear; and a first swing gear and a second swing gear to connect with the clutch gear when the driving motor rotates in a first direction and a second direction, respectively, wherein the conveying unit and the cap member are driven simultaneously by the driving motor.

7. The apparatus of claim 6, further comprising:

a loading unit in which the printing medium is loaded;

a pickup roller to pick up the printing medium from the loading unit; and a pickup motor to drive the pickup roller.

8. An image forming apparatus, comprising:

a print head unit including a nozzle unit having a plurality of nozzles to eject ink to form an image on a printing medium;

a conveying unit to convey the printing medium along a conveying path to the print head unit;

a capping unit comprising a capping member to separate the nozzle unit from an environment surrounding the nozzle unit, the capping unit being rotatable between a capping position at which the nozzle unit is capped by the capping member and an uncapping position at which the nozzle unit is uncapped;

a driving unit to generate a driving force to drive the conveying unit to convey the print medium along the conveying path to the print head unit, and to drive the capping unit to move to the capping position and the uncapping position; and a clutch unit to prevent the driving force from driving the capping unit when the capping unit is at the uncapping position, wherein the driving unit comprises:

a driving motor to generate the driving force, the driving motor being rotatable in a first direction to drive the conveying unit to convey the print medium along the conveying path to the print head unit and to drive the capping unit to move to the uncapping position, and a second direction to drive the capping unit to move to the capping position, wherein the conveying unit comprises:

a roller to convey the printing medium and a conveying gear to rotate the roller, and the driving unit comprises a pulley to transmit the driving force generated by the driving motor to the clutch gear and the conveying gear, wherein the clutch unit further comprises:

a first clutch part to prevent the driving force from driving the capping unit when the capping unit is in the uncapping position, the first clutch part comprising a first idle portion corresponding to the uncapping position and the first swing gear to communicate with the clutch gear; and a second clutch part to prevent the driving force from driving the capping unit when the capping unit is in the capping position, the second clutch part comprising a second idle portion corresponding to the capping position and the second swing gear to communicate with the clutch gear.

* * * * *